US007683921B2

(12) United States Patent
Hatakenaka

(10) Patent No.: US 7,683,921 B2
(45) Date of Patent: Mar. 23, 2010

(54) METHOD OF CONTROLLING A THERMAL HEAD

(75) Inventor: Takashi Hatakenaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 267 days.

(21) Appl. No.: 11/892,766

(22) Filed: Aug. 27, 2007

(65) Prior Publication Data

US 2008/0062238 A1 Mar. 13, 2008

(30) Foreign Application Priority Data

Sep. 13, 2006 (JP) ..... 2006-247670

(51) Int. Cl.
*B41J 2/35* (2006.01)
*B41J 2/36* (2006.01)

(52) U.S. Cl. ..... 347/211

(58) Field of Classification Search ..... 347/211
See application file for complete search history.

(56) References Cited

FOREIGN PATENT DOCUMENTS

| | | | |
|---|---|---|---|
| FR | 2 696 78 A1 | 4/1994 | |
| JP | 61-123550 A | 6/1986 | |
| JP | 6-210889 A | 8/1994 | |
| JP | 8-142376 A | 6/1996 | |
| JP | 10-305607 A | 11/1998 | |
| JP | 2001-138561 A | 5/2001 | |

OTHER PUBLICATIONS

Computer-generated translation of JP 06-210889, published on Aug. 2, 1994.*

* cited by examiner

*Primary Examiner*—Huan H Tran
(74) *Attorney, Agent, or Firm*—Birch, Stewart, Kolasch & Birch, LLP

(57) ABSTRACT

The present invention provides a method of controlling a thermal head which is capable of maintaining high image sharpness even in high-speed printing. In the method of controlling a thermal head according to the present invention, resistors constituting the thermal head is energized and non-energized, thereby realizing an image with a predetermined gradation. Further, one line period includes one energizing period in which energization is performed and one non-energizing period in which non-energization is performed, and the resistors are energized during the energizing period after the non-energizing period in the one line period.

1 Claim, 2 Drawing Sheets

METHOD OF CONTROLLING A THERMAL HEAD

BACKGROUND OF THE INVENTION

1. Field of the Invention

The present invention relates to a method of controlling a thermal head.

2. Description of the Background Art

A thermal head, hitherto provided in a printer and the like, includes a plurality of resistors. Based on data for printing, each resistor is selectively energized to execute printing on sheet surface.

Further, the thermal head has hitherto been controlled in a manner as described below for realizing an image with a predetermined gradation on one line. Namely, one line period is constituted by an energizing period in which resistors are energized and a non-energizing period in which the resistors are not energized. The non-energizing period is provided after the energizing period. More specifically, in the one line period, the resistors are energized during the energizing period after the start of the one line period, and the non-energizing period is provided after the energizing period.

For example, when printing an image with relatively low gradation (dark-colored image) is required, resistors are energized from the line-start, and after a lapse of the relatively long energizing period, the relatively short non-energizing period is elapsed (line-end). On the other hand, when printing an image with relatively high gradation (lightly colored image) is required, the resistors are energized from the line-start, and after a lapse of the relatively short energizing period, the relatively long non-energizing period is elapsed (line-end).

As thus described, by adopting the method of controlling a thermal head in which the energizing period is provided from the line-start and the non-energizing period is provided after the energizing period for each line, it is possible to represent an image with a predetermined gradation on each line.

As background art documents relating to the above-mentioned conventional method of controlling a thermal head, there are, for example, Japanese Patent Application Laid-Open No. 2001-138561, Japanese Patent Application Laid-Open No. 8-142376 and Japanese Patent Application Laid-Open No. 10-305607.

With the conventional method of controlling a thermal head as described above, there has been a problem that when a moving speed of a thermal head (or moving speed of sheet) becomes high, the thermal head comes into a state where its thermal response does not follow the speed. Therefore, e.g., on a changing portion (border) from black to white (or white to black), the image sharpness is impaired.

SUMMARY OF THE INVENTION

An object of the present invention is to provide a method of controlling a thermal head, which is capable of maintaining high image sharpness even in high-speed printing.

According to the present invention, the method of controlling a thermal head is capable of realizing an image with a predetermined gradation on each line by energizing and non-energizing resistors constituting the thermal head. One line period is constituted by one energizing period in which energization is performed and one non-energizing period in which non-energization is performed. Further, in the one line period, the non-energizing period is first present from the start of the one line period, and the energizing period is present subsequent to the non-energizing period.

Accordingly, a relatively long non-energizing period provided at the start of a predetermined one line can be functioned for the purpose of eliminating heat of the resistors. Further, a relatively short energizing period after the non-energizing period can be functioned for the purpose of providing the resistors with remaining heat, while preventing generation of a color. Therefore, due to the influence of the relatively long non-energizing period, it is possible to prevent reduction in image sharpness in a change from white to black even in high-speed printing. Further, due to the influence of the relatively short energizing period, it is possible to prevent reduction in image sharpness in a change from black to white.

These and other objects, features, aspects and advantages of the present invention will become more apparent from the following detailed description of the present invention when taken in conjunction with the accompanying drawings.

DESCRIPTION OF THE PREFERRED EMBODIMENTS

In the following, the present invention is specifically described with reference to the drawings illustrating its embodiments.

Embodiment

Figure 1:
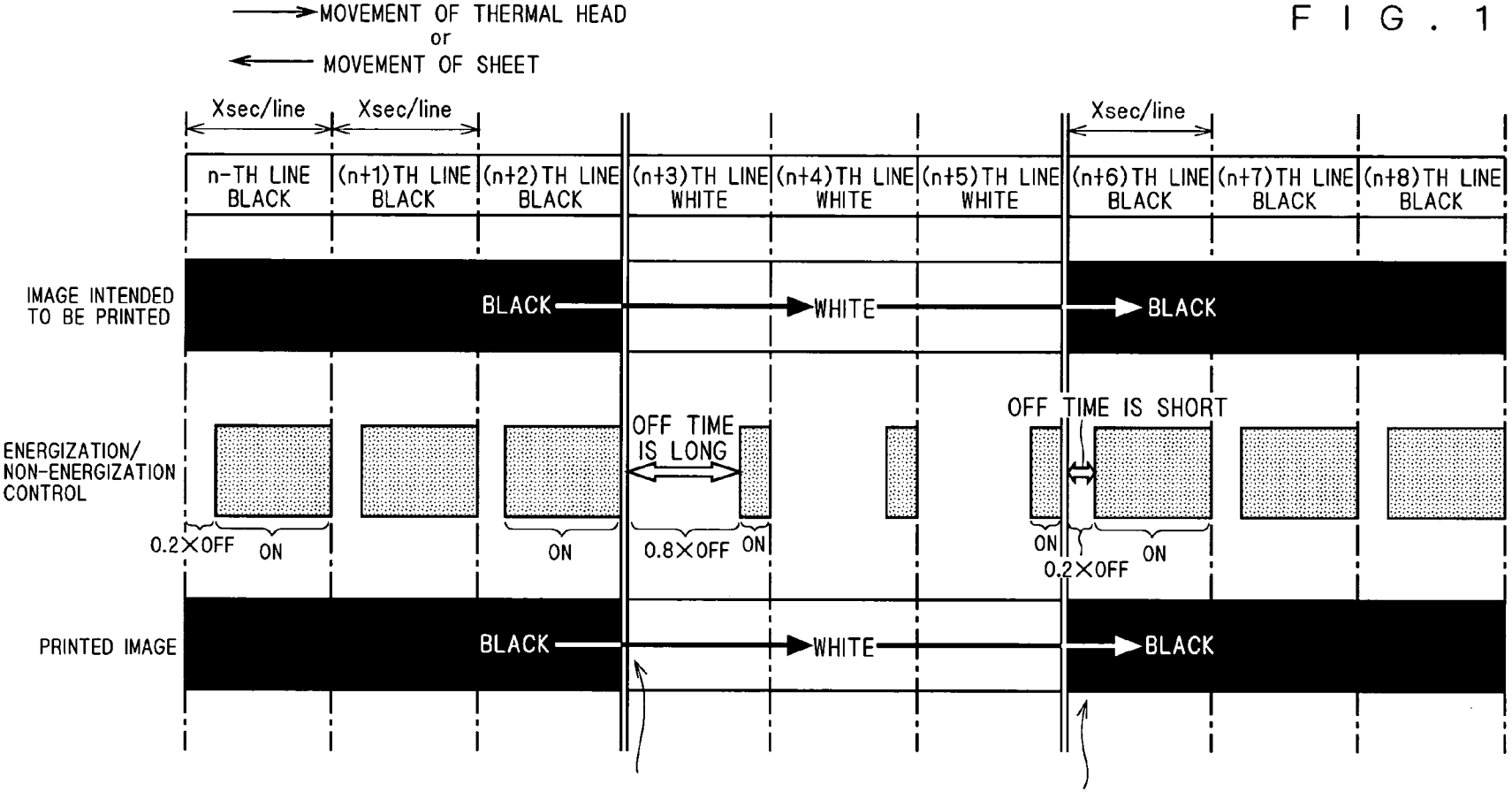
FIG. 1 is a view for explaining a method of controlling a thermal head according to the present invention.

FIG. 1 is a view for explaining a method of controlling a thermal head according to the present invention.

FIG. 1 shows, in order from the top, an "image intended to be printed", "energization/non-energization control", and a "printed image". It is to be noted that in the description of the present embodiment, a thermal head (or sheet) moves at a rate of X second per line in the direction from left to right (or from right to left) in FIG. 1. Further, FIG. 1 shows in order from the left side to the right side, "n-th line", "(n+1)th line", "(n+2)th line", . . . "(n+8)th line".

In the description of the present embodiment, a case is described where, for example, the n-th to (n+2)th lines are printed with a "black" gradation, the (n+3)th to (n+5)th lines are printed with a "white" gradation, and the (n+6)th to (n+8) th lines are printed with the "black" gradation, as shown in FIG. 1 (see the "image intended to be printed" on the upper level of FIG. 1).

In the method of controlling a thermal head according to the present invention, when performing printing as above, an electric current is passed through resistors constituting the thermal head based on the energization/non-energization control shown on the middle level of FIG. 1.

First, for printing an image with the "black" gradation (relatively dark image, i.e. image with relatively low gradation) on the n-th line, the current is not passed through the resistors (namely, this can be taken as the non-energizing period in which the resistors are non-energized) for, for example, about 0.2 X second from the line-start of the n-th line. The resistors are energized after the lapse of the 0.2 X second until the end of the n-th line (i.e. the line-start of the (n+1)th line) (namely, this can be taken as the energizing period in which the resistors are energized).

Similarly, for printing images with the "black" gradation (relatively dark image, i.e. images with relatively low gradation) on the (n+1)th, (n+2)th, and (n+6)th to (n+8)th lines, the current is not passes through the resistors (namely, this can be taken as the non-energizing period in which the resistors are non-energized) for, for example, about 0.2 X second from the line-start of the (n+1)th, (n+2)th, and (n+6)th to (n+8)th lines. The resistors are energized after the lapse of the 0.2 X second until the end of the (n+1)th, (n+2)th, and (n+6)th to (n+8)th lines (i.e. the line-start of the (n+2)th, (n+3)th, and (n+7)th to (n+9)th lines) (namely, this can be taken as the energizing period in which the resistors are energized).

Contrary to this, for printing an image with the "white" gradation on the (n+3)th line, the current is not passed through the resistors (namely, this can be taken as the non-energizing period in which the resistors are non-energized) for, for example, about 0.8X second from the line-start of the (n+3)th line. The resistors are energized after the lapse of the 0.8 X second until the end of the (n+3)th line (i.e. the line-start of the (n+4)th line) (namely, this can be taken as the energizing period in which the resistors are energized).

Similarly, for printing images with the "white" gradation on the (n+4)th and (n+5)th lines, the current is not passed through the resistors (namely, this can be taken as the non-energizing period in which the resistors are non-energized) for, for example, about 0.8X second from the line-start of the (n+4)th and (n+5)th lines. The resistors are energized after the lapse of the 0.8 X second until the end of the (n+4)th and (n+5)th lines (i.e. the line-start of the (n+5)th and (n+6)th lines) (namely, this can be taken as the energizing period in which the resistors are energized).

It is to makes the resistors to have remaining heat in preparation for a case of subsequently printing an image with the "black" gradation (relatively dark image) that the short energizing period is provided to the extent not to generate a color even in the case of printing an image with the "white" gradation.

As seen from the above descriptions, in the method of controlling a thermal head according to the present invention, one line period is constituted by one energizing period in which resistors are energized and one non-energized period in which the resistors are not energized. Further, in order to realize an image with a predetermined gradation on each line, the resistors are energized during the energizing period after a lapse of the non-energizing period in one line period.

Further, as seen from the above description, in the case of realizing an image with the "black" gradation (relatively dark image, i.e. image with relatively low gradation), the above-mentioned non-energizing period is set (controlled) to be relatively short. Contrary to this, in the case of realizing an image with the "white" gradation (relatively lightly colored image, i.e. image with relatively high gradation), the above-mentioned non-energizing period is set (controlled) to be relatively long.

Figure 2:
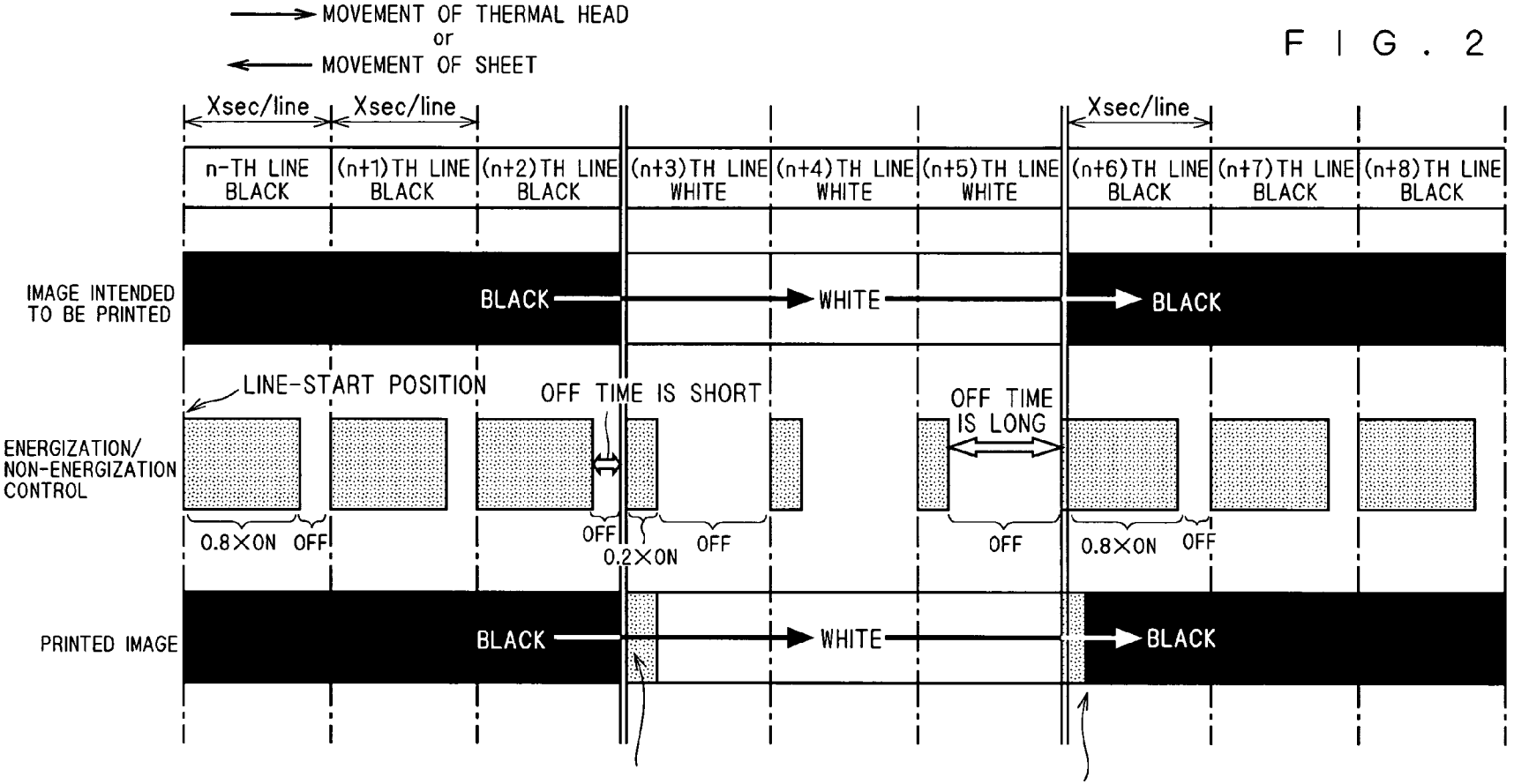
FIG. 2 is a view for explaining a method of controlling a thermal head according to the background art.

Next, the method of controlling a thermal head according to the background art is described before an effect exerted in the case of performing the method of controlling a thermal head according to the present invention is described. FIG. 2 is a view for explaining the method of controlling a thermal head according to the background art. It should be noted that in FIG. 2, descriptions of the items except for the "energization/non-energization control" and the "printed image" ("image intended to be printed", print speed, configuration of each line, etc.) are the same as those in FIG. 1.

With the method of controlling a thermal head according to the background art, in the case of printing an image as shown on the upper level of FIG. 2, a current is passed through resistors constituting the thermal head based on the energization/non-energization control shown on the middle level of FIG. 2.

First, for printing an image with the "black" gradation on the n-th line, the resistors are energized for, for example, about 0.8 X second from the line-start of the n-th line (energizing period). The current is not passed through the resistors after the lapse of the 0.8 X second until the end of the n-th line (i.e. the line-start of the (n+1)th line) (non-energizing period).

Similarly for printing images with the "black" gradation also on the (n+1)th, (n+2)th, and (n+6)th to (n+8)th lines, the resistors are energized for, for example, about 0.8 X second from the line-start of the (n+1)th, (n+2)th, and (n+6)th to (n+8)th lines (energizing period). The current is not passed through the resistors after the lapse of the 0.8 X second until the end of the (n+1)th, (n+2)th, and (n+6)th to (n+8)th lines (i.e. the line-start of the (n+2)th, (n+3)th, and (n+7)th to (n+9)th lines) (non-energizing period).

Contrary to this, for printing an image on the (n+3)th line with the "white" gradation, the resistors are energized for, for example, about 0.2 X second from the line-start of the (n+3)th line (energizing period). The current is not passed through the resistors after the lapse of the 0.2 X second until the end of the (n+3)th line (i.e. the line-start of the (n+4)th line) (non-energizing period).

Similarly, for printing images with the "white" gradation on the (n+4)th and (n+5)th lines, the resistors are energized for, for example, about 0.2 X second from the line-start of the (n+4)th and (n+5)th lines (energizing period). The current is not passed through the resistors after the lapse of the 0.2 X second until the end of the (n+4)th and (n+5)th lines (i.e. the line-start of the (n+5)th and (n+6)th lines) (non-energizing period).

As seen from the above descriptions, with the method of controlling a thermal head according to the background art, one line period is constituted by one energizing period in which resistors are energized and one non-energized period in which the resistors are not energized. Further, in order to realize an image with a predetermined gradation on each line, the current is not passed through the resistors during the non-energizing period after the lapse of the energizing period in one line period.

Since the controlling method as described above is adopted in the background art, when the moving speed of the thermal head (or sheet) becomes high, the image sharpness is impaired in changing portions (borders) from black to white and white to black, as shown in the "printed image" on the lower level of FIG. 2.

For example, when focusing on a vicinity of the border between the (n+2)th line and the (n+3)th line, the non-energizing period in the (n+2)th line is short. Therefore, when the short energizing period is started at the line-start of the (n+3) th line, a dark gray image (image with relatively low gradation) is undesirably printed since the resistors have remaining heat. (Namely, the change from black to white becomes gentle on the border, thereby impairing the image sharpness.)

Further, for example, when focusing on a vicinity of the border between the (n+5)th line and the (n+6)th line, the non-energizing period in the (n+5)th line is long. Since this causes the resistors to have little remaining heat at the line-start of the (n+6)th line, even when the energizing period is started in synchronization with the line-start of the (n+6)th line, some time is required until the temperatures of the resistors reach a predetermined temperature at which "black" color is generated. Therefore, a gray image is undesirably printed during a certain period after the line-start of the (n+6)

th line (namely, the change from white to black becomes gentle on the border, thereby impairing the image sharpness.)

Contrary to this, with the method of controlling a thermal head according to the present invention, the resistors are energized during the energizing period after the non-energizing period in one line period, as described above. Therefore, even when the moving speed of the thermal head (or sheet) becomes high, high image sharpness can be maintained in changing portions (borders) from black to white and white to black, as shown in the "printed image" on the lower level of FIG. 1.

For example, attention is made on a vicinity of the border between the (n+2)th line and the (n+3)th line. After the start of the non-energizing period, the temperatures of the resistors decrease rapidly to temperatures at which a color may not be generated. Therefore, high image sharpness can be maintained in this border.

Further, a relatively short energizing period is provided after the lapse of a relatively long non-energizing period in the (n+3)th line. Therefore, the resistors have little remaining heat before the start of the energizing period (namely, it is possible to have the relatively long non-energizing period function for the purpose of eliminating the remaining heat in the resistors). Hence, even when the relatively short energizing period is provided, the temperatures of the resistors will not reach so high a temperature that a color may be generated. That is, the relatively short energizing period does not function for generating a color, but function only for the purpose of generating remaining heat of the resistors prepared for the case of subsequently printing a dark-colored image or the like. Accordingly, as described above, a color is not generated on the (n+3)th line even when the relatively short energizing period is provided therein.

Moreover, for example, when focusing on a vicinity of the border between the (n+5)th line and the (n+6)th line, a relatively short energizing period is provided during a period until the line-end of the (n+5)th line. In view of the above observation, it can be taken that this relatively short energizing period also functions only for the purpose of generating remaining heat of the resistors in preparation for the case of subsequently printing a dark colored image or the like. Accordingly, a color is not generated on the (n+5)th line even when the energizing period is provided therein.

Furthermore, the non-energizing period in the (n+6)th line is short. Therefore, the remaining heat in the resistors that has been heated during the energizing period in the (n+5)th line can be effectively used. Namely, in the case of providing the energizing period after the short non-energizing period on the (n+6)th line, the temperatures of the resistors reach a temperature necessary for generating the "black" color immediately (rapidly) after the start of the energizing period. Therefore, the image sharpness can be maintained high in this border. In addition, although different from the figure, it can be taken that the actual starting time for printing a black image is the time immediately after the start of the energizing period (e.g. immediately after the lapse of 0.2X second in the (n+6)th line).

It is to be noted that the method of controlling a thermal head according to the present invention is applicable, for example, to a thermal printer, a thermal sublimation printer, and the like, in which the thermal head is used.

While the invention has been shown and described in detail, the foregoing description is in all aspects illustrative and not restrictive. It is therefore understood that numerous modifications and variations can be devised without departing from the scope of the invention.

What is claimed is:

1. A method of controlling a thermal head, which is capable of realizing an image with a predetermined gradation on each line by energizing and non-energizing resistors constituting the thermal head, wherein one line period is constituted by one energizing period in which said energization is performed and one non-energizing period in which said non-energization is performed, and in said one line period, said non-energizing period is first present from the start of said one line period, and in all line periods, said energizing period is present subsequent to said non-energizing period.

* * * * *